US010694788B2

(12) United States Patent
Profeta

(10) Patent No.: US 10,694,788 B2
(45) Date of Patent: Jun. 30, 2020

(54) NON-SLIP UNDERGARMENT

(71) Applicant: Victoria Profeta, Los Angeles, CA (US)

(72) Inventor: Victoria Profeta, Los Angeles, CA (US)

( * ) Notice: Subject to any disclaimer, the term of this patent is extended or adjusted under 35 U.S.C. 154(b) by 0 days.

(21) Appl. No.: 15/958,304

(22) Filed: Apr. 20, 2018

(65) Prior Publication Data

US 2019/0320726 A1 Oct. 24, 2019

(51) Int. Cl.
*A41B 9/00* (2006.01)
*A41B 17/00* (2006.01)
*A41B 9/04* (2006.01)

(52) U.S. Cl.
CPC ..... *A41B 9/001* (2013.01); *A41B 9/04* (2013.01); *A41B 17/00* (2013.01); *A41B 2300/22* (2013.01)

(58) Field of Classification Search
CPC ..... A41B 9/001; A41B 17/00; A41B 2300/22
See application file for complete search history.

(56) References Cited

U.S. PATENT DOCUMENTS 2,166,012 A 1/1939 La Maida
RE21,624 E 1/1940 Dann
3,590,823 A * 7/1971 Pope, Jr. ..... A41F 11/18 450/95
3,854,978 A * 12/1974 Campbell, Sr. ..... A41F 9/00 427/375
3,930,090 A * 12/1975 Campbell, Sr. ..... A41F 9/00 428/196
4,390,999 A * 7/1983 Lawson ..... A41B 11/14 2/409
4,612,674 A 9/1986 Hashimoto
4,894,869 A 1/1990 Boll
5,359,732 A 11/1994 Waldman et al.
5,708,986 A 1/1998 Belardinelli
5,954,564 A * 9/1999 Ganz ..... A41C 1/003 2/73
6,446,268 B1 * 9/2002 Lazarian ..... A41B 11/126 2/237
6,704,942 B2 3/2004 Lazarian
(Continued)

FOREIGN PATENT DOCUMENTS

EP 3 021 703 5/2016
KR 200476391 2/2016

OTHER PUBLICATIONS

Machine Translation of Korean Patent No. KR200476391 issued on Feb. 16, 2016.

*Primary Examiner* — Richale L Quinn
(74) *Attorney, Agent, or Firm* — Davidson, Davidson & Kappel, LLC

(57) ABSTRACT

A non-slip undergarment is provided which includes comprising an undergarment having a top side defining a waistband, a front panel, a back panel, and a crotch line, the front panel, back panel and crotch line defining a pair of leg openings, the front panel, back panel, and crotch line together covering at least a portion of the lower abdomen and buttocks of a wearer of the undergarment. Each of the leg openings having, on the back panel, a corresponding anti-slip strip, each anti slip strip extending from the crotch line upwards only part-way along the corresponding leg opening on the back panel.

10 Claims, 3 Drawing Sheets

(56) References Cited

U.S. PATENT DOCUMENTS

| | | | | |
|---|---|---|---|---|
| 6,712,841 | B2 * | 3/2004 | Gomez | A41D 13/1254 2/400 |
| 7,159,621 | B2 * | 1/2007 | Shannon | A41B 9/001 139/422 |
| 7,257,847 | B2 * | 8/2007 | Hart | A41B 9/001 2/406 |
| 8,990,965 | B2 * | 3/2015 | Waldman | A41D 27/02 2/69 |
| 9,565,877 | B2 * | 2/2017 | Martinet | A41C 3/065 |
| 9,833,023 | B2 * | 12/2017 | Sabin | A41B 9/004 |
| 9,955,739 | B2 * | 5/2018 | Melarti | A41C 1/12 |
| 10,165,801 | B2 * | 1/2019 | Blibech | A41B 9/02 |
| 10,231,492 | B1 * | 3/2019 | Bastug | A41C 3/0007 |
| 2007/0174950 | A1 * | 8/2007 | Gidish | A41B 9/04 2/406 |
| 2009/0047481 | A1 * | 2/2009 | Welsch | A41C 5/00 428/179 |
| 2009/0048481 | A1 | 2/2009 | Welsch et al. | |
| 2009/0181599 | A1 | 7/2009 | Farmer et al. | |
| 2011/0111673 | A1 | 5/2011 | Soeda | |
| 2014/0304899 | A1 | 10/2014 | Almonte | |
| 2014/0359920 | A1 * | 12/2014 | Sabin | A41B 9/004 2/406 |
| 2015/0111466 | A1 * | 4/2015 | Martinet | A41C 3/065 450/41 |
| 2016/0038346 | A1 * | 2/2016 | Collins | A61F 13/08 602/63 |
| 2016/0157529 | A1 | 6/2016 | Hoeven | |
| 2017/0258144 | A1 * | 9/2017 | Bardini | A41B 9/001 |
| 2017/0354543 | A1 * | 12/2017 | Mazourik | A61F 13/08 |
| 2018/0360132 | A1 * | 12/2018 | Melarti | A41C 1/06 |
| 2019/0125003 | A1 * | 5/2019 | Hanson Allen | A41B 9/04 |

* cited by examiner

NON-SLIP UNDERGARMENT

FIELD OF THE INVENTION

The present invention relates to undergarments such as panties or briefs.

BACKGROUND

Undergarments such as panties or briefs are well known in the art, and are typically designed with elastic waistbands and elastic leg openings to fit the undergarment to the body of the user.

However, despite the use of such elastic waistbands and elastic leg openings, a problem exists in that the undergarment tends to rise upward from its initial position due to movement by the wearer, such as walking, sitting, standing, etc. Further, as the undergarment rises upward, it bunches up, forming visible lines through clothing commonly referred to as panty-lines.

It is known in the art to provide an anti-slip strip made, for example, of silicone along the entirety of each leg opening of the panty.

SUMMARY OF THE INVENTION

Conventional panties, including those with an anti-slip strip along the entirety of the leg opening do not satisfactorily prevent bunching and panty-lines.

In accordance with various embodiments of the present invention, an anti-slip undergarment is provided which reduces the movement of the undergarment on the body of the wearer, thereby reducing or eliminating the occurrence of panty-lines.

In accordance with an embodiment of the present invention, a non-slip undergarment is provided which includes an undergarment having a top side defining a waistband, a front panel, a back panel, and a crotch line, the front panel, back panel and crotch line defining a pair of leg openings. The front panel, back panel, and crotch line together cover at least a portion of the lower abdomen and buttocks of a wearer of the undergarment. Each of the leg openings have, on the back panel, a corresponding anti-slip strip, each anti slip strip extending from the crotch line upwards only part-way along the corresponding leg opening on the back panel. In this regard, the crotch line may be a crotch seam, or in fabrications that do not have a crotch seam (e.g. where the front and back are of single piece construction), the term crotch line is to be understood to be located in substantially the same position as a crotch seam.

In accordance with further variants of the above-embodiment, the undergarment may optionally include other features including (i) wherein each anti-slip strip is made of silicone; and/or (ii) wherein each anti-slip strip extends from the crotch line upwards for no more than 3.5 inches along the corresponding leg opening on the back panel; and/or (iii) wherein each anti-slip strip extends from the crotch line upwards from 2 to 5 inches along the corresponding leg opening on the back panel; and/or (iv) wherein each anti-slip strip extends from the crotch line upwards for no more than 3 inches along the corresponding leg opening on the back panel; and/or (v) wherein a distance from a center from of the top side to the crotch line is from 12 to 13 inches, +/−⅛ inch; and/or (vi) wherein a distance from center back of the top side to the crotch line is from 10.5 to 1.5 inches, +/−⅛ inch; and/or (vii) wherein the anti-slip strip has a wavy or sinusoidal shape.

DETAILED DESCRIPTION

In accordance with an embodiment of the present invention, an anti-slip undergarment is provided. The undergarment is preferably a panty, preferably provides full coverage, but is designed to not show a panty line through the clothing of the wearer. In this regard, a thin strip of silicone or other anti-slip material is provided which is preferably between 2 and 5 inches (and more preferably approximately three and a half inches) long, that is positioned on the elastic of the underwear at the lowest part of the thigh/buttocks area. In this way, the silicone strip is designed to fit perfectly into the bottom crease of the butt cheek. Positioned in this way, the underwear sits in the right place on the butt/leg and will remain in place because of the silicone and not show a panty line through clothing. As used herein, the term panty is understood to encompass panties, undies, underwear, lingeries, bikini briefs, underpinnings, and boy shorts, and the like, which cover at least a portion of the lower abdomen and buttocks of a wearer of the undergarment.

Figure 1B:
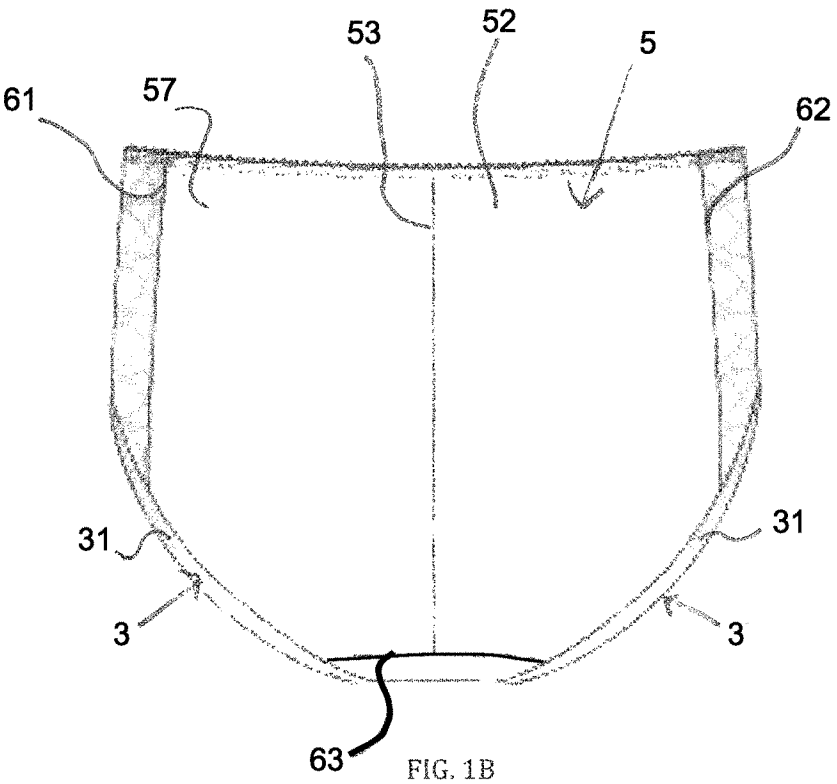
FIGS. 1A and 1B show the front and back of an anti-slip undergarment in accordance with an embodiment of the present invention.
Figure 1A:
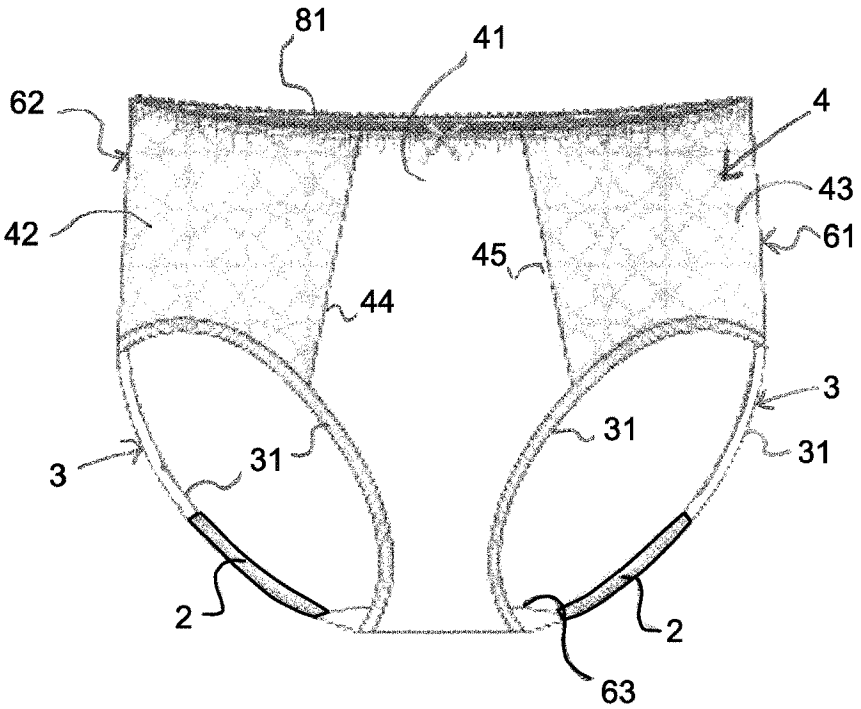

FIGS. 1A and 1B show the front and back of an illustrative undergarment 1 with anti-slip strips 2 on leg openings 3.

In this exemplary embodiment, the undergarment has a five-piece construction. A front panel 4 is comprised of front center-piece 41, and front side pieces 42 and 43, joined along opposing vertically inclined seams 44, 45. A back panel 5 is comprised of back side pieces 51 and 52 joined along a vertical seam 53. Back side piece 51 is joined to front side piece 42 along a right-side vertical seam 61. Back side piece 52 is joined to front side piece 43 along a left-side vertical seam 62. Back side pieces 51 and 52 are joined to front center-piece 41 along a crotch-seam or liner seam 63. The panels 41, 42, 42, 51, and 52 may be made of fabric, such as cotton, nylon, SPANDEX®, polyester, and the like, and may be joined together at seams 61, 62, 63 via stitching.

An elastic waistband 81 is attached to a top of the front panel 4, forming a top side of the undergarment.

As illustrated the front panel 4 and back panel 5 define the leg openings 3 having elastic bands 31. Anti-slip strips 2 are provided on the leg openings 3, preferably on top of the elastic bands 31 and extend from the crotch seam 63 upward on the leg openings 3 on the back panel 5. Importantly, the anti-slip strips do not extend along the entirety of the leg openings 3 on the back panel 5. Rather, they extend only part-way upward from the crotch seam 63. Preferably, they extend from the crotch seam 63 upwards for no more than 3.5 inches along the corresponding leg opening 3 on the back panel 5.

Figure 2:
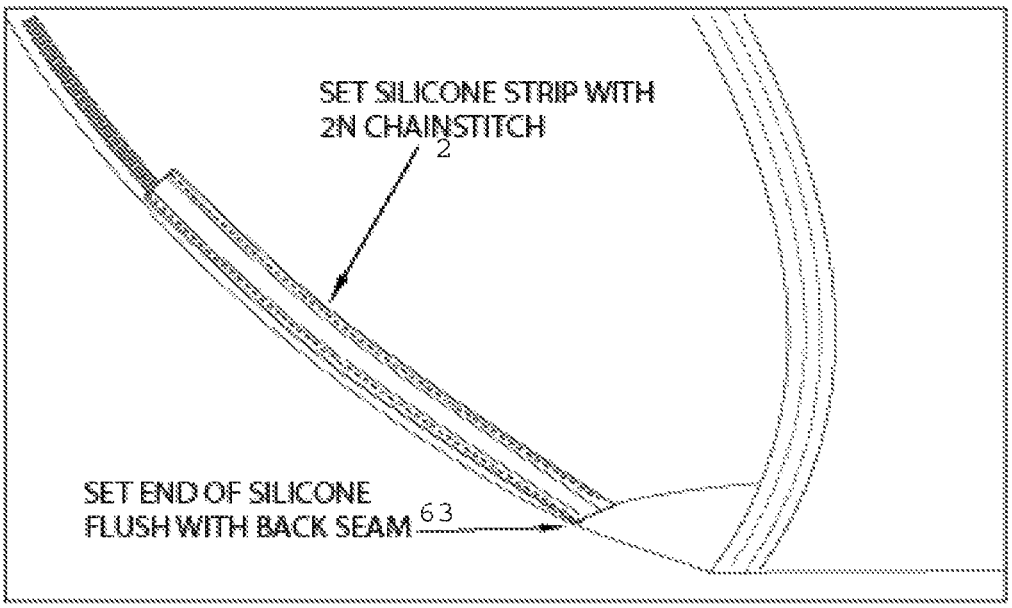
FIG. 2 shows an anti-slip strip of the embodiment of FIGS. 1A-1B in further detail.
Figure 3:
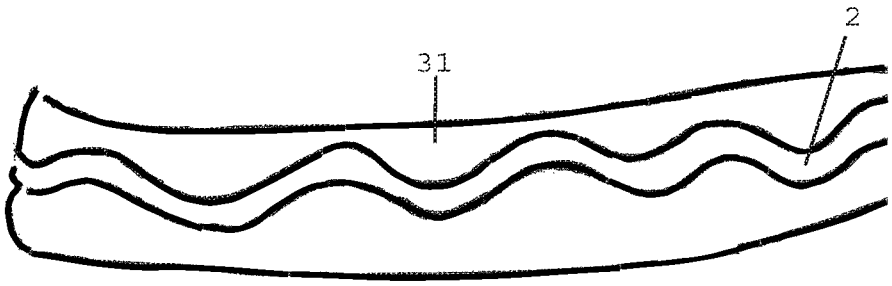
FIG. 3 shows an anti-slip strip with a wavy or sinusoidal shape.

The anti-slip strips 2 may be stitched over the elastic bands as shown in FIG. 2. The anti-slip strips are preferably made of silicone, with the silicone or other anti-slip material exposed to the wearer's skin. The anti-slip strips may have a shape that is straight (FIG. 2) or one that sinusoidal or wavy (FIG. 3). Other shapes may also be used.

Table 1 below shows illustrative dimensions for the non-slip undergarment.

TABLE 1

| | Tol-er-ance | XS | Target Size S | M | L |
|---|---|---|---|---|---|
| CENTER FRONT (CF) LENGTH (CF TO CROTCH SEAM) | ⅛ | 12.25 | 12.5 | 12.75 | 13 |
| CENTER BACK (CB) LENGTH (CB TO CROTCH SEAM) | ⅛ | 10.75 | 11 | 11.25 | 11.5 |
| CUT WAIST ELASTIC | ¼ | 23.5 | 24.5 | 25.5 | 26.5 |
| WAIST FINISHED RELAXED (TOTAL) | ¼ | 23 | 24 | 25 | 26 |
| CUT LEG ELASTIC | ⅛ | 16.5 | 17.5 | 18.5 | 20 |
| LEG OPENING FINISHED - RELAXED (TOTAL) | ⅛ | 16 | 17 | 18 | 19.5 |
| SILICONE STRIP LENGTH | ⅛ | 3 | 3 | 3 | 3 |

All values in inches

Although the panels of the undergarment 1 have been illustrated in FIG. 5 as having a five-piece construction (41, 42, 43, 51, 52), it should be understood that a greater or lesser number of pieces may be used. As an illustration, the front panel may, for example, be made of a one or two pieces of fabric rather than three, and/or the back panel may be made of a single piece of fabric rather than 2. Further, a single piece of material could alternatively form both the front and back panels.

In the preceding specification, the invention has been described with reference to specific exemplary embodiments thereof. It will, however, be evident that various modifications and changes may be made thereto without departing from the broader spirit and scope of the invention as set forth in the claims that follow. The specification and drawings are accordingly to be regarded in an illustrative manner rather than a restrictive sense.

What is claimed is:

1. A non-slip undergarment comprising:

an undergarment having a top side defining a waistband, a front panel, a back panel, and a crotch line, the front panel, back panel and crotch line defining a right leg opening and a left leg opening, the front panel, back panel, and crotch line together covering at least a portion of the lower abdomen and buttocks of a wearer of the undergarment, the crotch line having a first end flush with the right leg opening and a second end flush with the left leg opening;

the left leg opening having, on the back panel, a first anti-slip strip, the right leg opening having, on the back panel, a second anti-slip strip;

wherein the first and second anti slip strips each have a length and width, the length being greater than the width, the length of each of the first and second anti slip strips being no more than 3.5 inches;

the first anti slip strip positioned at the first end of the crotch line and extending lengthwise from the first end of the crotch line upwards only part-way along the right leg opening on the back panel, the second anti slip strip positioned at the second end of the crotch line and extending lengthwise from the second end of the crotch line upwards only part-way along the left leg opening on the back panel, the first anti slip strip being spaced apart from the second anti slip strip;

wherein the first anti-slip strip is located lengthwise over an elastic band of the right leg opening, and wherein the second anti-slip strip is located lengthwise over an elastic band of the left leg opening.

2. The non-slip undergarment of claim 1, wherein the crotch line is a crotch seam.

3. The non-slip undergarment of claim 1, wherein each of the first and second anti-slip strips is made of silicone.

4. The non-slip undergarment claim 1, wherein each of the first and second anti-slip strips extend from the crotch line upwards for no more than 3 inches along the corresponding leg opening on the back panel.

5. The non-slip undergarment claim 1, wherein a distance from a center front of the top side to the crotch line is from 12 to 13 inches, +/−⅛ inch.

6. The non-slip undergarment claim 1, wherein a distance from a center back of the top side to the crotch line is from 10.5 to 1.5 inches, +/−⅛ inch.

7. The non-slip undergarment claim 1, wherein at least one of the first and second anti-slip strips has a wavy or sinusoidal shape.

8. A non-slip undergarment comprising:

an undergarment having a top side defining a waistband, a front panel, a back panel, and a crotch line, the front panel, back panel and crotch line defining a right leg opening and a left leg opening, the front panel, back panel, and crotch line together covering at least a portion of the lower abdomen and buttocks of a wearer of the undergarment, the crotch line having a first end flush with the right leg opening and a second end flush with the left leg opening;

the left leg opening having, on the back panel, a first anti-slip strip, the right leg opening having, on the back panel, a second anti-slip strip;

wherein the first and second anti slip strips each have a length and width, the length being greater than the width, the length of each of the first and second anti slip strips being 2 to 5 inches;

the first anti slip strip positioned at the first end of the crotch line and extending lengthwise from the first end of the crotch line upwards only part-way along the right leg opening on the back panel, the second anti slip strip positioned at the second end of the crotch line and extending lengthwise from the second end of the crotch line upwards only part-way along the left leg opening on the back panel, the first anti slip strip being spaced apart from the second anti slip strip;

wherein the first anti-slip strip is located lengthwise over an elastic band of the right leg opening, and wherein the second anti-slip strip is located lengthwise over an elastic band of the left leg opening.

9. The non-slip undergarment claim 1, wherein the left and right leg openings defined by the front panel, back panel and crotch line each have a length of at least 16+/−⅛ inches.

10. The non-slip undergarment claim 8, wherein the left and right leg openings defined by the front panel, back panel and crotch line each have a length of at least 16+/−⅛ inches.

* * * * *